US006273215B1

(12) United States Patent
Horan et al.

(10) Patent No.: US 6,273,215 B1
(45) Date of Patent: Aug. 14, 2001

(54) MULTI VEHICLE POSITION CANTILEVERED LIFT

(75) Inventors: Gerald P Horan; Philip M. Carlton, both of Pickering (CA)

(73) Assignee: Chart Industries Ltd., Pickering (CA)

( * ) Notice: Subject to any disclaimer, the term of this patent is extended or adjusted under 35 U.S.C. 154(b) by 0 days.

(21) Appl. No.: 09/083,983

(22) Filed: May 26, 1998

(51) Int. Cl.[7] ..... B66F 7/06; B66F 7/28

(52) U.S. Cl. ..... 187/203; 187/204; 187/218; 187/359; 187/377; 254/89 H

(58) Field of Search ..... 187/203, 204, 187/205, 218, 219, 220, 351, 359, 377; 254/89 H; 52/296, 292, 250, 223.13, 698; 248/352; 414/228, 233, 234, 261

(56) References Cited

U.S. PATENT DOCUMENTS

| | | | | |
|---|---|---|---|---|
| 2,857,985 | * | 10/1958 | Simmon, Sr. | 187/203 X |
| 2,915,143 | * | 12/1959 | Simmon, Sr. | 187/203 X |
| 3,415,342 | * | 12/1968 | Hott | 187/219 X |
| 4,520,649 | * | 6/1985 | Barton, Sr. | 248/352 X |
| 4,585,198 | * | 4/1986 | Chartier et al. | 187/219 X |
| 4,976,336 | * | 12/1990 | Curran | 187/219 X |

FOREIGN PATENT DOCUMENTS

| | | | | |
|---|---|---|---|---|
| 2108882 | * | 5/1972 | (FR) | 187/220 |
| 930723 | * | 5/1972 | (CA) | 187/205 |

* cited by examiner

*Primary Examiner*—Robert P. Olszewski
*Assistant Examiner*—Thuy V. Tran
(74) *Attorney, Agent, or Firm*—Neil H. Hughes; Ivor M. Hughes; Marcelo K. Sarkis

(57) ABSTRACT

A multiple vehicle position cantilevered lift comprising a stiff support for a cantilevered lift, said support being sized so as to be resistant to twist and torque loads, said support having a base plate with openings for selective alignment with openings provided in a concrete floor or footing, the openings in said floor having disposed therein an anchoring member comprising a compressible sleeve having a predetermined diameter and a threaded piston, having a predetermined diameter slightly larger than the cylinder and being contained in said sleeve and having a threaded internal or interior wall for receiving an anchor bolt and having a substantially tapered outer wall wherein as the bolt is fastened to a predetermined torque, the piston rises in the sleeve and expands the sleeve compressing the sleeve outwardly against the concrete surrounding the opening to anchor the sleeve and the bolt in the base plate, said support including framework to movably engage and support at least one cantilevered vehicle lift moveable between a first lowered position and a second raised position respectively for at least one vehicle, said lift having a drive provided for each cantilevered lift position, wherein a vehicle may be lifted at each lift position without interfering with the adjacent lift position.

6 Claims, 11 Drawing Sheets

(5 of 11 Drawing Sheet(s) Filed in Color)

PHOTOGRAPH #1
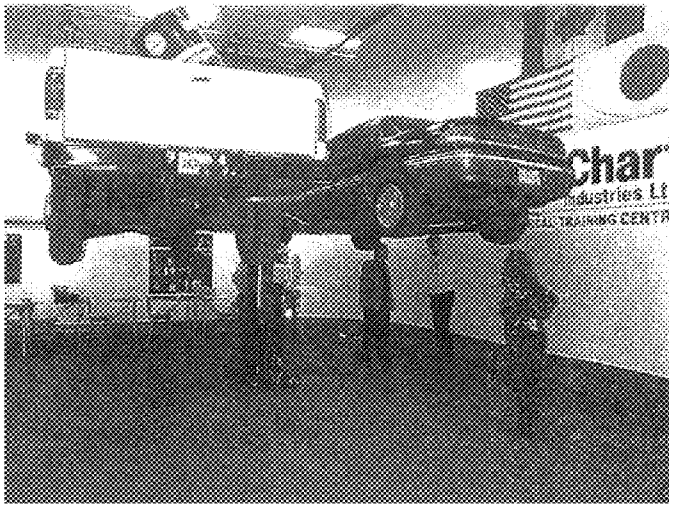
PHOTOGRAPH #2
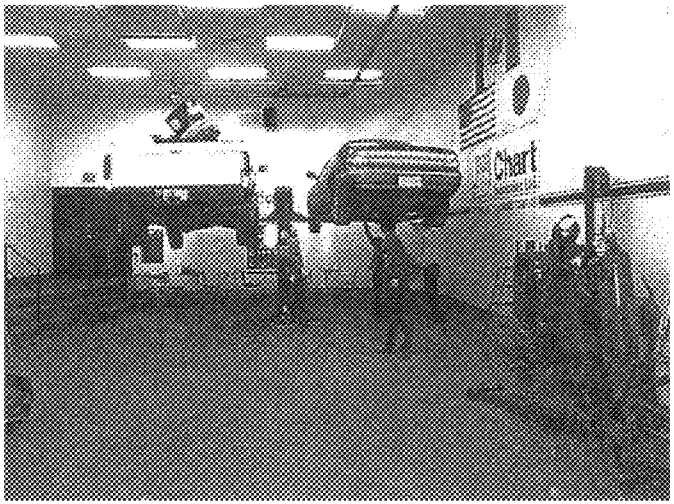
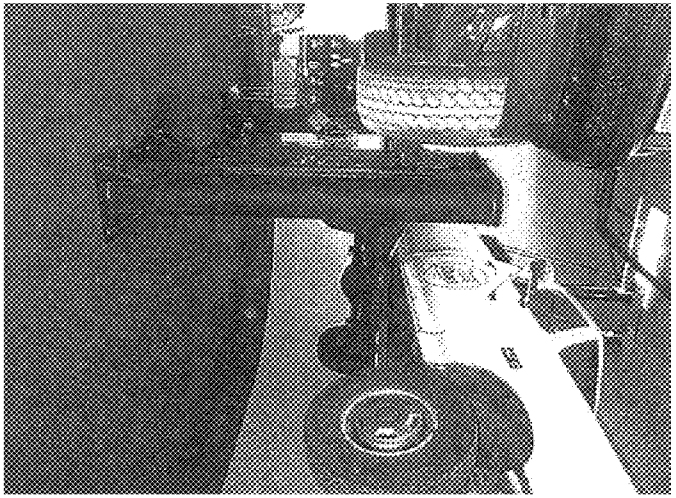
PHOTOGRAPH #3
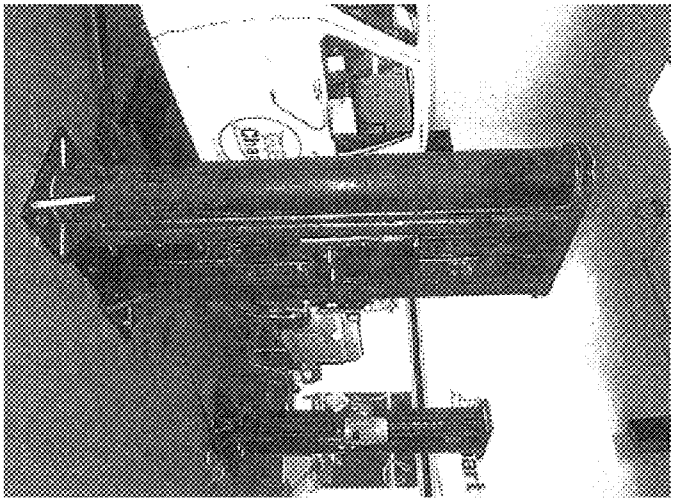
PHOTOGRAPH #4

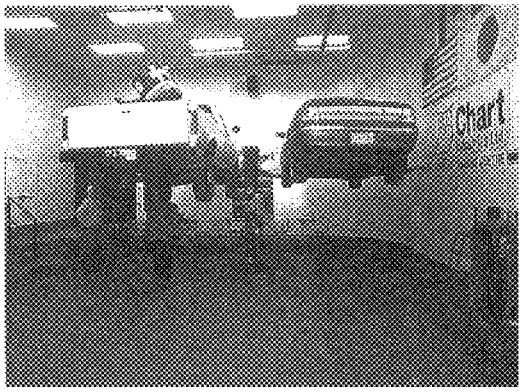
PHOTOGRAPH #5
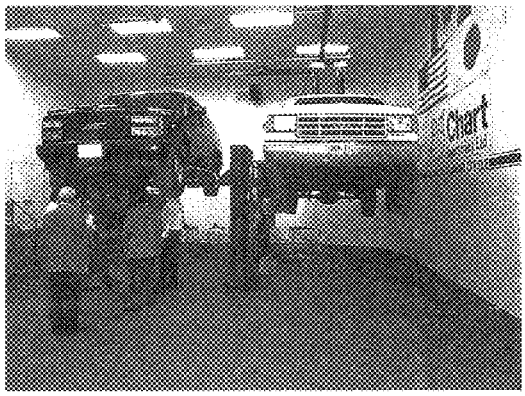
PHOTOGRAPH #6
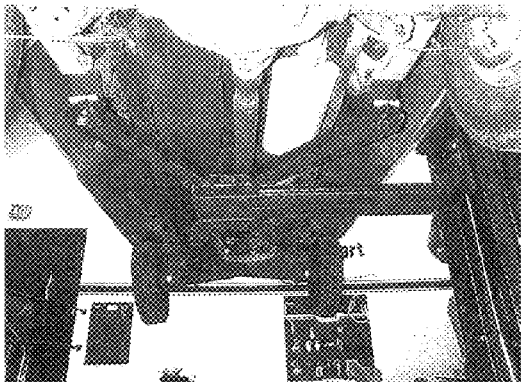
PHOTOGRAPH #7
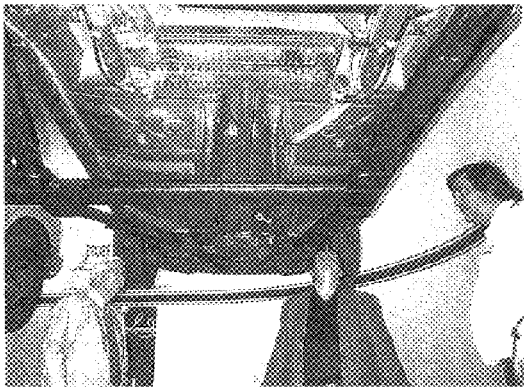
PHOTOGRAPH #8

PHOTOGRAPH #9
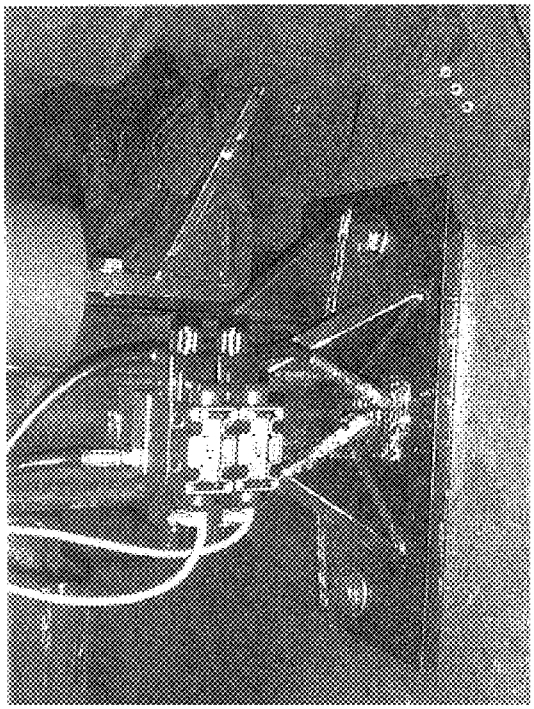
PHOTOGRAPH #10
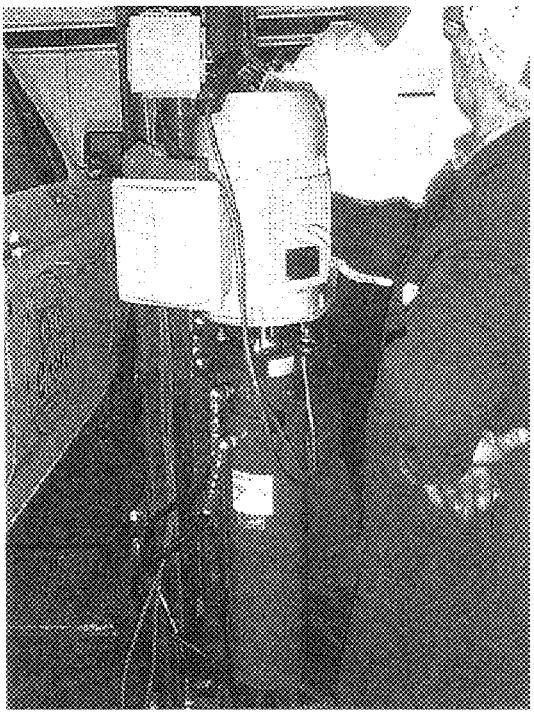
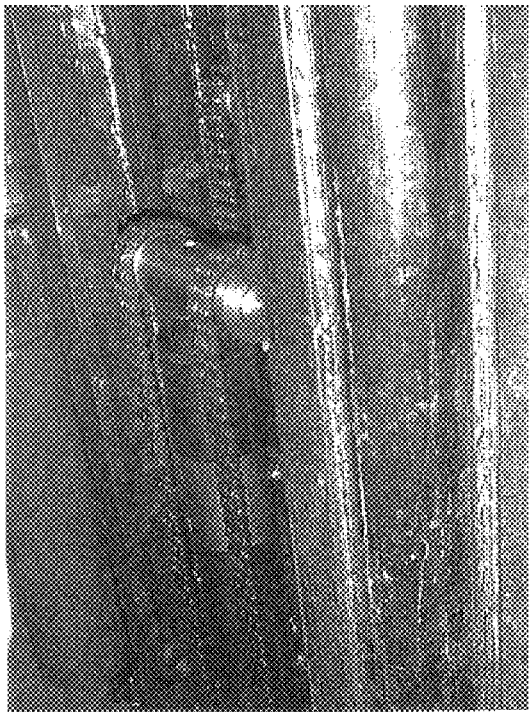
PHOTOGRAPH #11
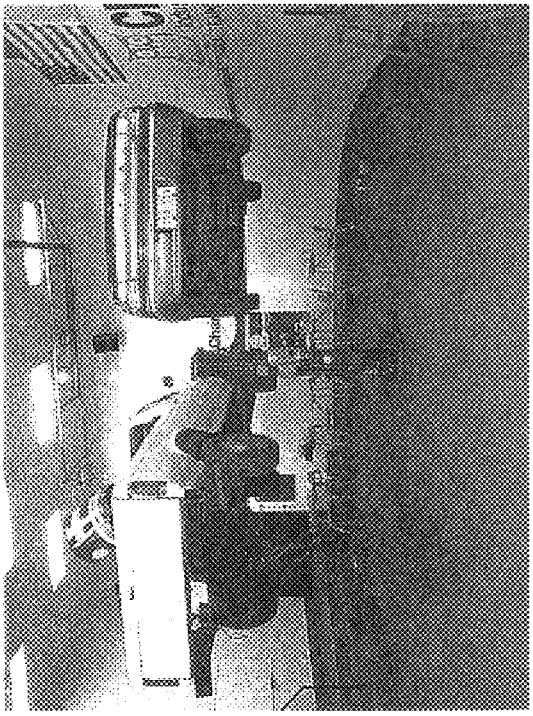
PHOTOGRAPH #12

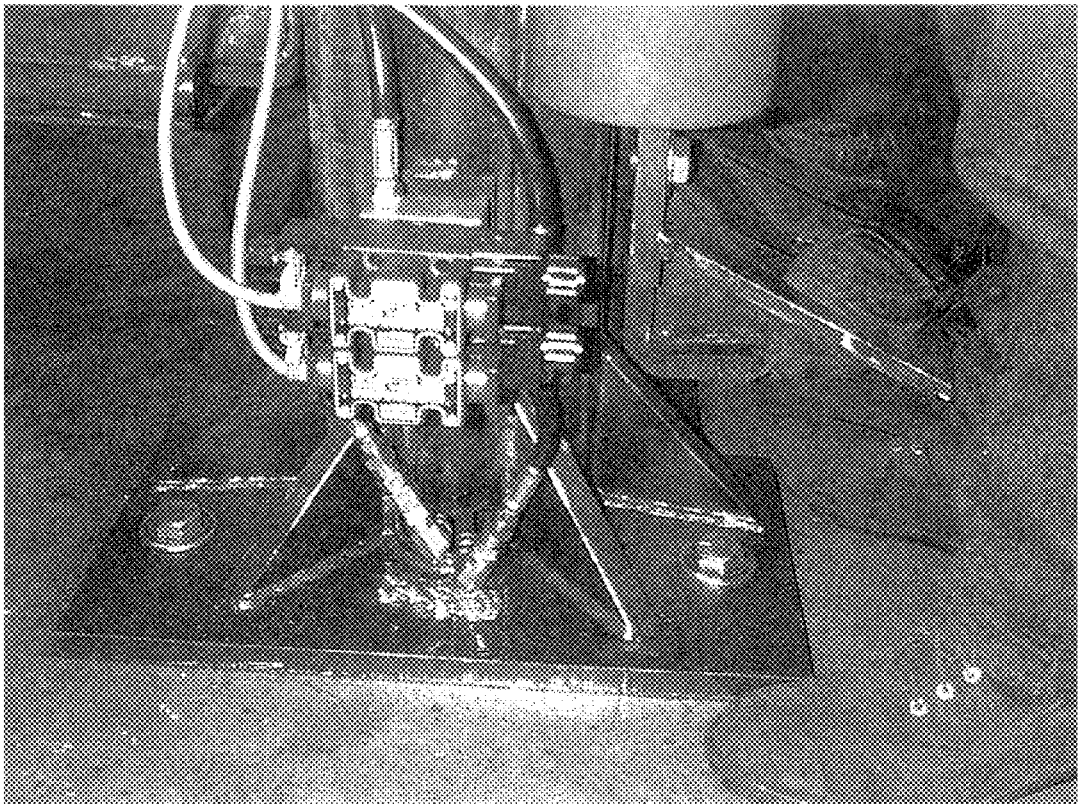
PHOTOGRAPH #13

PHOTOGRAPH #14
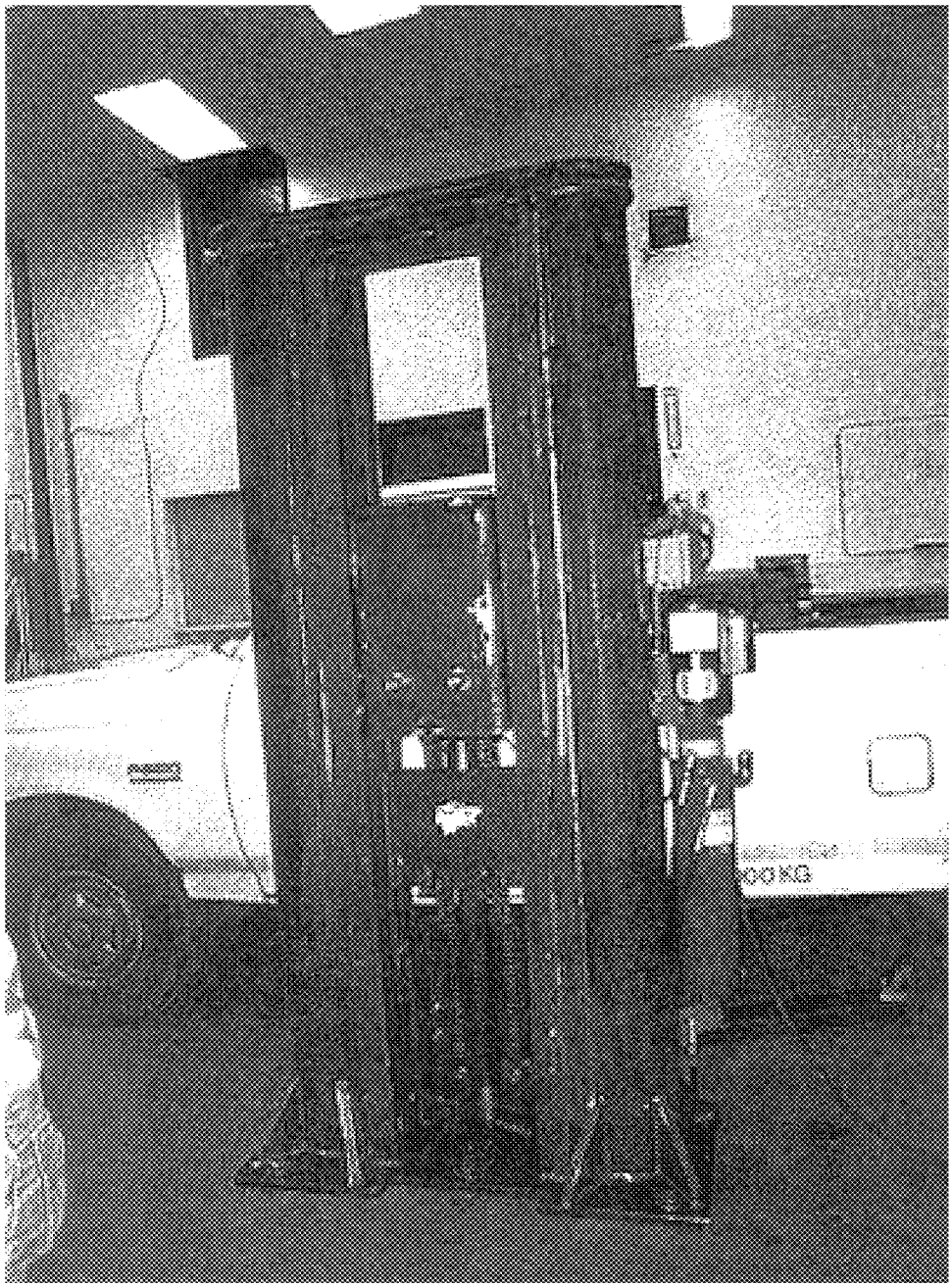

MULTI VEHICLE POSITION CANTILEVERED LIFT

FIELD OF THE INVENTION

This invention relates to cantilevered lifting devices and finds particular application to such a device, having a central support from which a predetermined number of above ground cantilevered vehicle lifts are movably supported.

BACKGROUND OF THE INVENTION

A multitude of various types of automotive and vehicle lifts exist. For example, typically within a mechanic's garage there may be found a inground lift operating from a central cylinder having a lifting platform attached thereto for engagement with a vehicle. Typically a vehicle drives over the lifting platform and is lifted to a position where the vehicle can be serviced.

There are a considerable number of environmental concerns which must be addressed with respect to the central inground lift. Primarily, in order to operate such a lift, an underground reservoir for hydraulic fluid must be accommodated in an underground pit. The service technician repairs the inground lift below ground level. Any leak in the supply tanks can be considerably detrimental to the environment.

As a result of these environmental concerns, the greater majority of lifting apparatus's installed today are surface mounted lifts, which are bolted to the concrete garage floor that are normally powered by an electric motor which operates a hydraulic ram or a screw type drive. The surface mounted lifts are normally bolted in position. However, portable units have found some uses in the industry today. Scissor lifts are also well known in the industry.

Another type of lift that is found in the industry, is a cantilevered type of lift, such as the portable type manufactured by Bend-Pak, Model ML-6 of Santa Paulo, Calif. Such cantilevered lifts may include frame engaging portions which utilize flip-up, stackable or threaded contacts or foot pads located at the end of each of the lift arms. These contacts or pads which are adjustable to several different positions are engaged with the various lifting points recommended by the vehicle manufacture. Outriggers or extenders may also be utilized to engage the recommended lifting points.

When utilizing the afore-mentioned devices, typically a single bay is provided for each lifting apparatus having predetermined dimensions, so as to easily fit and accommodate a vehicle to be worked on. When building new facilities where space is not as much of a premium as with older facilities, then not a great deal of hardship is realized. However, with older facilities where the head space is inadequate, such as those facilities in older portions of a city, when considering replacing lifting apparatus's, a simple replacement of the facilities is normally considered. However, it would be advantageous to install a facility that improved the space utilization of the bay and realize a cost saving to the proprietor. Also, when considering head space, it would be advantageous to provide a lifting apparatus that lived within an eight foot ceiling height limitation.

It would therefore be an advantage to realize space savings by providing a multiple vehicle position cantilevered lift, hereto for unknown realizing a 20% space savings from conventional installations and a further 20% cost savings per lifting site. No where in the prior art to the best of applicant's knowledge is such a device available.

It is therefore a principle object of this invention to provide a multiple vehicle position cantilevered lift.

It is a further object of this invention to provide a multiple vehicle position cantilevered lift which is economical to manufacture and robust in structure.

It is a further object of this invention to provide such a structure which will realize the proprietor a space savings over present lifting apparatus's and their utilization of space.

It is yet a further object of this invention to provide an environmentally sound lifting apparatus.

Further another object of the invention will become apparent to those skilled in the art when considering the following summary of the invention and the more detailed description of the preferred embodiments illustrated herein.

SUMMARY OF THE INVENTION

According to a primary aspect of the invention, there is provided a multiple vehicle position cantilevered lift comprising a stiff support for a cantilevered lift, said support being sized so as to be resistant to twist and torque loads, said support having a base plate with openings for selective alignment with openings provided in a concrete floor or footing, the openings in said floor having disposed therein an anchoring member comprising a compressible sleeve having a predetermined diameter and a threaded piston, having a predetermined diameter slightly larger than the cylinder and being contained in said sleeve and having a threaded internal or interior wall for receiving an anchor bolt and having a substantially tapered outer wall preferably inclined at substantially in the range of 5°–100° from the vertical, wherein as the bolt is fastened to a predetermined torque, the piston rises in the sleeve and expands the sleeve compressing the sleeve outwardly against the concrete surrounding the opening to anchor the sleeve and the bolt in the base plate, said support including framework to movably engage and support at least one cantilevered vehicle lift moveable between a first lowered position and a second raised position respectively for at least one vehicle, said lift having a drive provided for each cantilevered lift position, preferably an electric motor engaged with either a hydraulic pump or a rotatable screw, said pump for pumping fluid to a substantially vertically oriented hydraulic cylinder, or alternatively said screw being oriented in a vertical direction, preferably said lift having cantilevered arms extending from a vehicle lifting framework extending from said cylinder or screw, said arms being moveable to engage a vehicle at appropriate undercarriage positions, said lift preferably including a ratchet operated safety mechanism to prevent the lift from moving from any of a multitude of raised positions, said safety including a multiplicity of vertical disposed openings in the frame engaged by a spring biased pin in a preferred embodiment, wherein a vehicle may be lifted at each lift position without interfering with the adjacent lift position.

According to a primary aspect of the invention, a multiple position cantilevered vehicle lift is provided incorporated in or assembled in a central support structure bolted to a concrete floor or footing for supporting at least two cantilevered lifts, each lift being operable independently of one another to raise and lower vehicles and each lift including a lifting apparatus to do so, for example a hydraulic cylinder or a rotating screw engaged with an electric drive or if the hydraulic cylinder is used engaged with a source of hydraulic fluid such as a pump and a hydraulic fluid reservoir, said support structure being sized so as to be very resistant and robust to twisting and torque loads, wherein a vehicle may be lifted at each lift position without interfering with an adjacent lift position. Preferably a safety mechanism may be provided for each lift to prevent the lift from moving from any one of an established raised position.

In one embodiment said central support structure includes two hollow columns spaced from one another and braced to a support plate anchored to said concrete floor or footing. Preferably each lift is affixed to said central support separately and may further comprise a lifting platform preferably including arms extending therefrom to support a vehicle. Preferably each lift is disposed proximate each side of said central support. In a preferred embodiment each platform is raised and lowered by a dedicated mechanisms such as a hydraulic cylinder or screw pillar.

In another embodiment the hollow supports may contain valves, pumps, or reservoirs and hoses.

It is imperative when providing the supports that they be extremely stiff and resist the torque loads and twisting loads that will be experienced when raising and lowering vehicles at alternative positions supported from the centrally disposed support. Literally, we have found that a larger footprint may therefore be required then those of standard type floor mounted systems. We have found that a 48" by 23" footprint is adequate, if the preferred two column like supports are adequately spaced apart having a diameter of 10 ¾" and a wall thickness of 0.31800 of an inch. Thus it may be provided proximate the bottom of the supports' reinforcements to reinforce the plate with respect to the supports and the base plate. It is recommended that the anchor bolt system described above be utilized and tightened to 1200 to 1500 foot pounds of torque in order to yield the required 60 ton tensile load capacity for each of the one inch anchor bolts. The material utilized in manufacturing the support structure is CSA G40.21 44W structural weldable steel. Preferably square I-beam type columns are attached and preferably welded to each of the spaced supports for the support structure.

The anchor assembly may further comprise a sleeve having a diameter of 3 ½" minus 0.050 inches and being cylindrical in shape and designed to allow for compression of the cylinder into the wall of the concrete surrounding the opening. The piston is designed having a base having a 3 ½" diameter plus in the range of 0.020 to 0.050 inches, so that as the piston is drawn up by the one inch bolt, preferably grade number 5, the base of the piston will compress the cylinder wall into the concrete continuously from the bottom of the cylinder toward the top of the cylinder until such time as the bolt is tightened to the predetermined and recommended torque of between 1200 and 1500 foot pounds. At that point the anchor is capable of 60 tons of tensile loading capacity on each bolt.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DETAILED DESCRIPTION OF THE PREFERRED EMBODIMENTS

Referring generally to the figures there is illustrated a multiple vehicle position cantilevered lift including a stiff supporting frame which is carefully sized and reinforced so as to be resistant to twisting and torque loads which result when two vehicles are serviced at the same time on the cantilevered lift. In order to provide the necessary frame work for supporting the vehicles it is imperative that a base plate be firmly anchored to the concrete or footing for the lift. The base should be reinforced to the supports to prevent twisting and flexing of the base as the cantilevered lift is loaded when servicing two vehicles at the same time. The cantilevered lift may therefore be operating between a vehicle access position and a vehicle service position by a carriage driven by conventional methods including a piston, a rotatable screw or any other manner known in the art. A safety mechanism may be added to the lift to prevent the carriage from dropping from the service positions.

Figure 1:
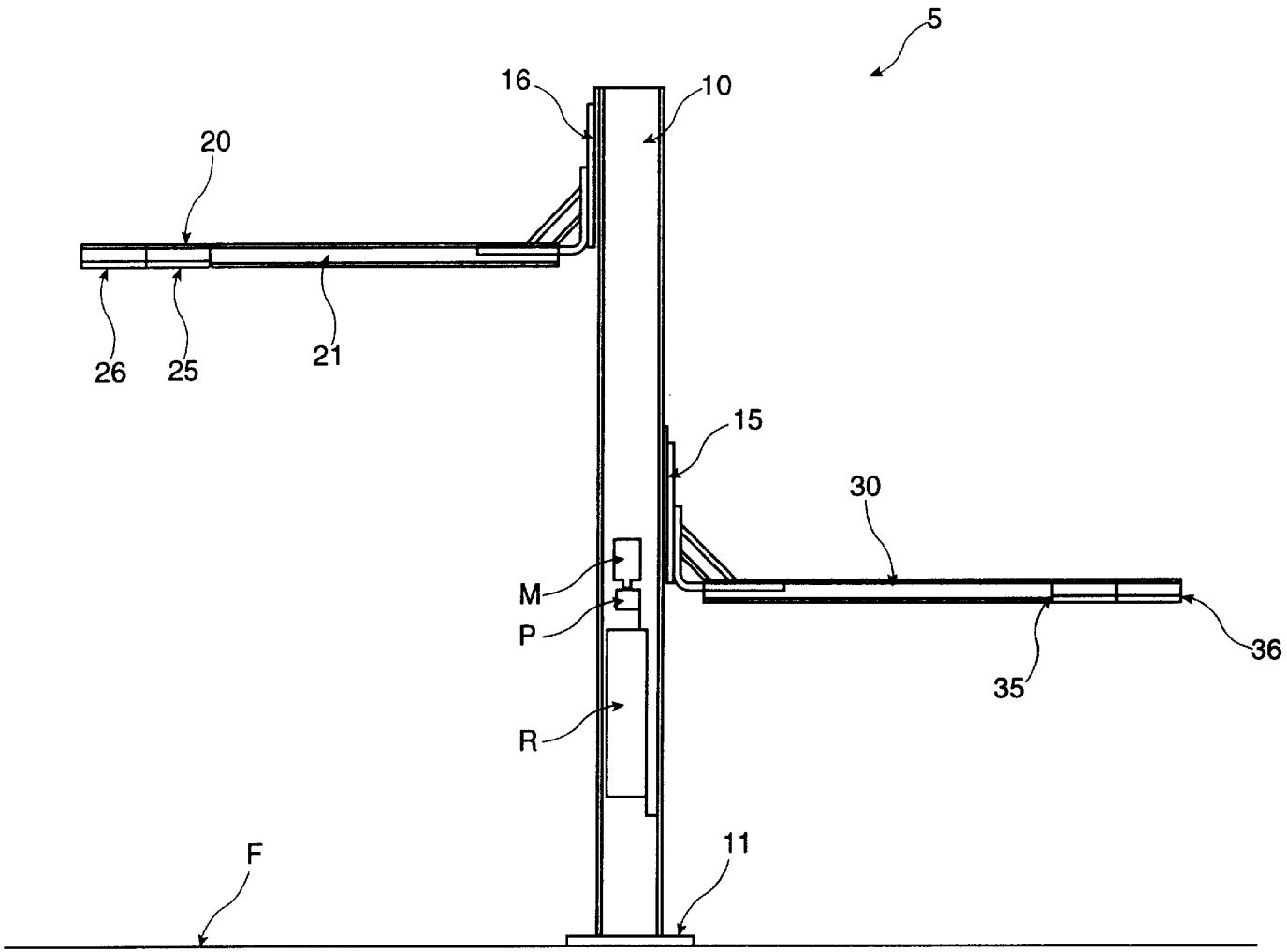
FIG. 1 is a schematic end view of the cantilevered lift illustrated in a preferred embodiment of the invention.
Figure 2:
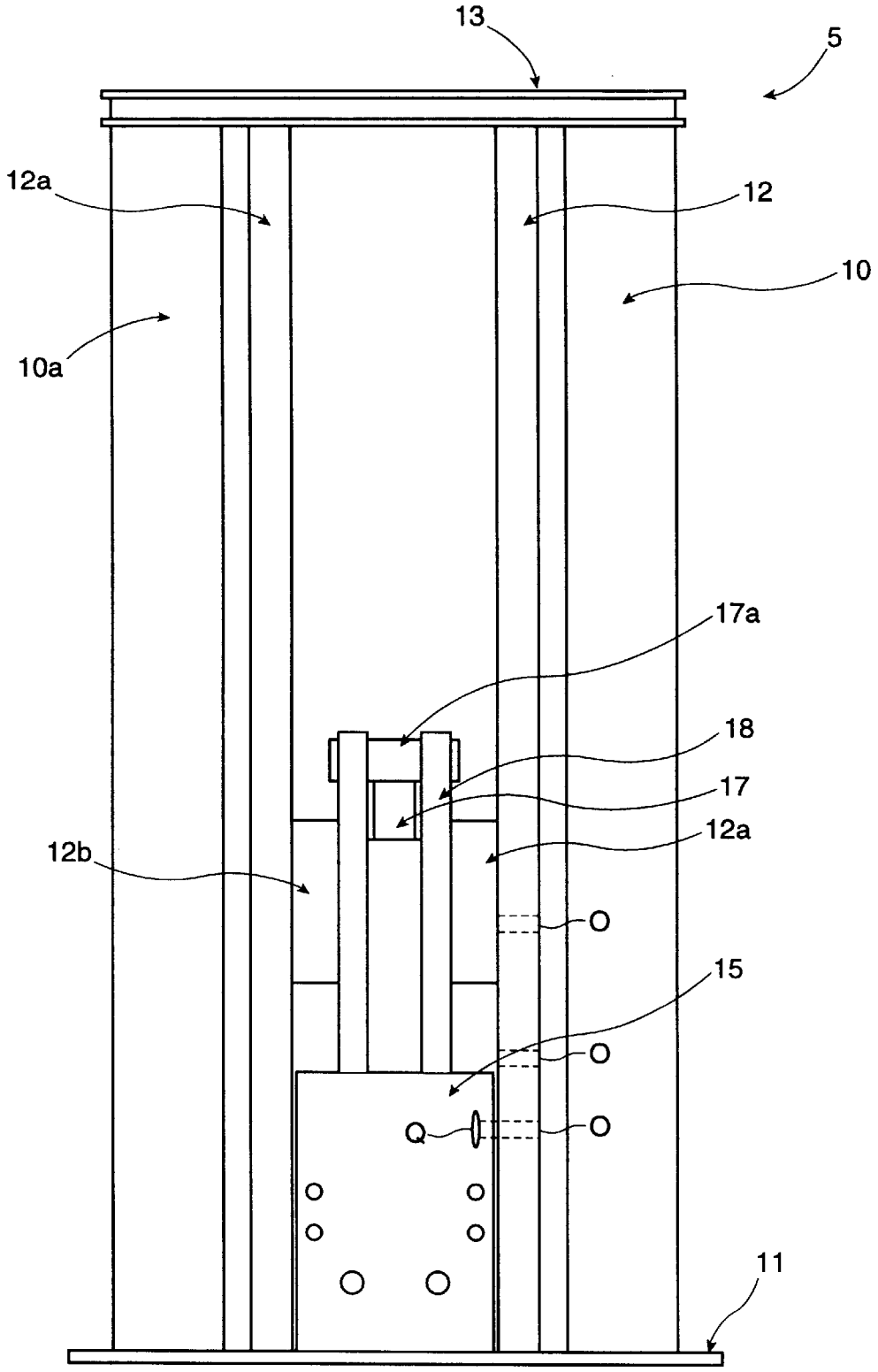
FIG. 2 is a schematic side view of the cantilevered lift illustrated in a preferred embodiment of the invention.
Figure 3:
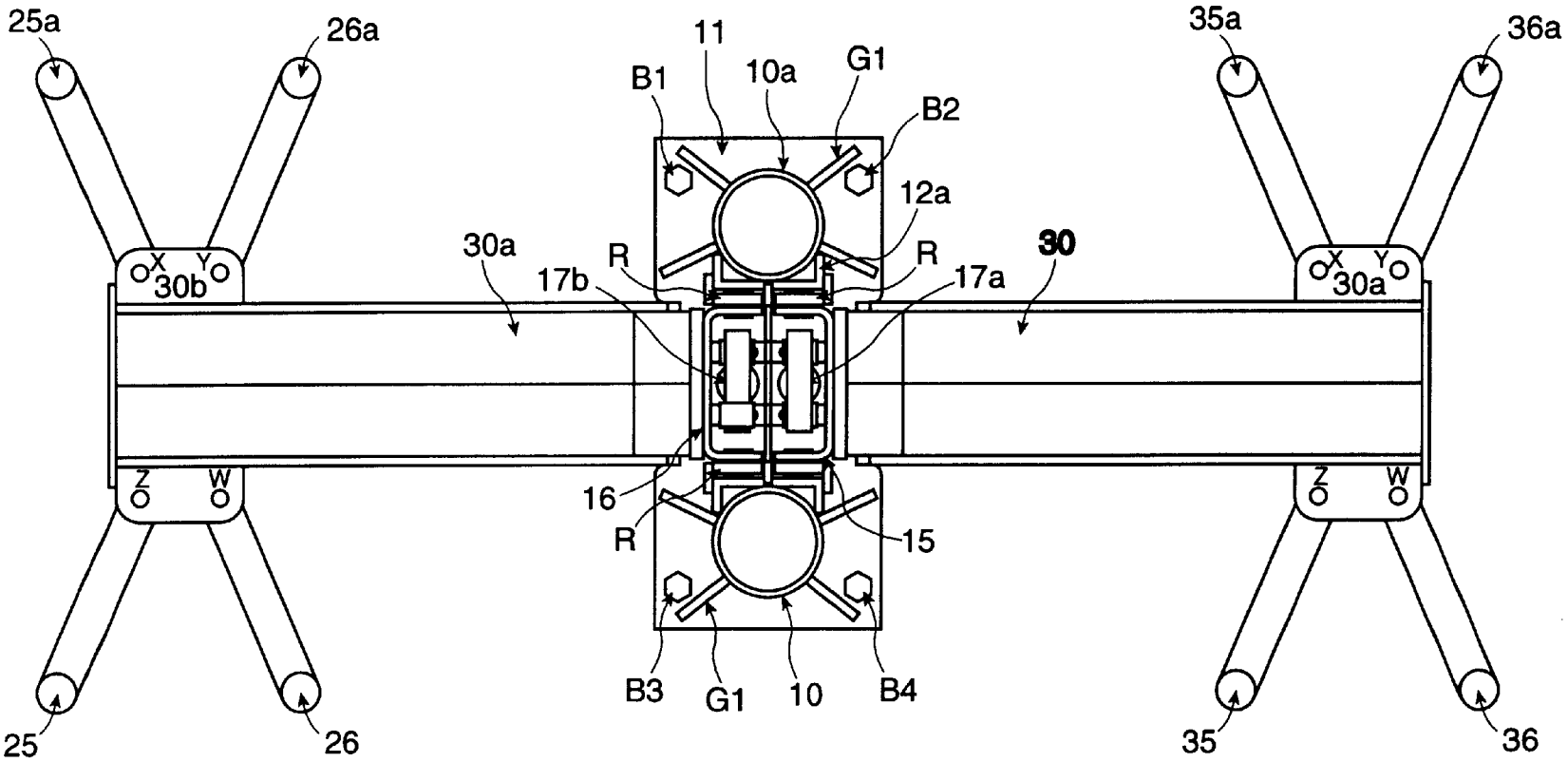
FIG. 3 is a schematic top view of the cantilevered lift illustrated in a preferred embodiment of the invention.

Referring now to FIGS. 1 and 2, there is illustrated a multiple vehicle position cantilevered lift (5), including upright supports (10 and 10A), having a base plate or floor plate (11), and a top plate (13), and for supporting a moveable lift carriage (15 and 16) engaged with a lifting tongue (20 and 30) having outwardly extending pivoting lift arms (35, 36, and 25, 26, 25A, 26A, 35A and 36A) respectively, including lifting pads (T) for engagement with the undercarriage of a vehicle (not shown). Each of the lifting carriages (15 and 16) are moved by a motor (M) directly driving a pump (P) pumping fluid from a reservoir (R) through to hydraulic ram (17) provided for each lifting carriage 15 and 16. Each upright support (10 and 10A) is generally cylindrical in shape seen in FIG. 3 and being hollow. Each upright support is attached and preferably welded to the base plate (11). The base plate (11) has attached and preferably welded thereto and also to each upright support (10 and 10A), gussets (G) as shown in FIG. 3 being generally triangular in shape and extending from the base of the triangle attached and preferably welded to the floor plate (11) and the adjacent side extending upwardly to the apex of the triangle being attached and preferably welded to the side of the supports (10 and 10A). The gussets (G) therefore provide reinforcing of the plate (11) to the upright support (10 and 10A) to accommodate twisting and other loads tending to deform the plate 11. The plate 11 is bolted to the floor (F) via bolts (B1, B2, B3 and B4) which will be described hereinafter in relation to FIG. 6. The moveable carriage (15 and 16), includes a safety mechanism which is provided in the assembly. A moveable spring biased pin (Q) is provided with the carriage which engages and disengages from openings (O) in the lifting frame as the lift moves. In the preferred embodiment the safety (Q) is operated manually as the hydraulic ram (17) is advanced upward. A lift chain (18) is engaged with the lift carriage (15) to assist the hydraulic ram in moving the carriage from the bottom position as seen in FIG. 2 to a service position seen in FIG. 1 in relation to carriage (16). The chain is engaged in a conventional manner and operates in a conventional manner. Alternatively of course, a screw drive could be utilized to move the carriage or any other alternative drive mechanism.

Figure 4:
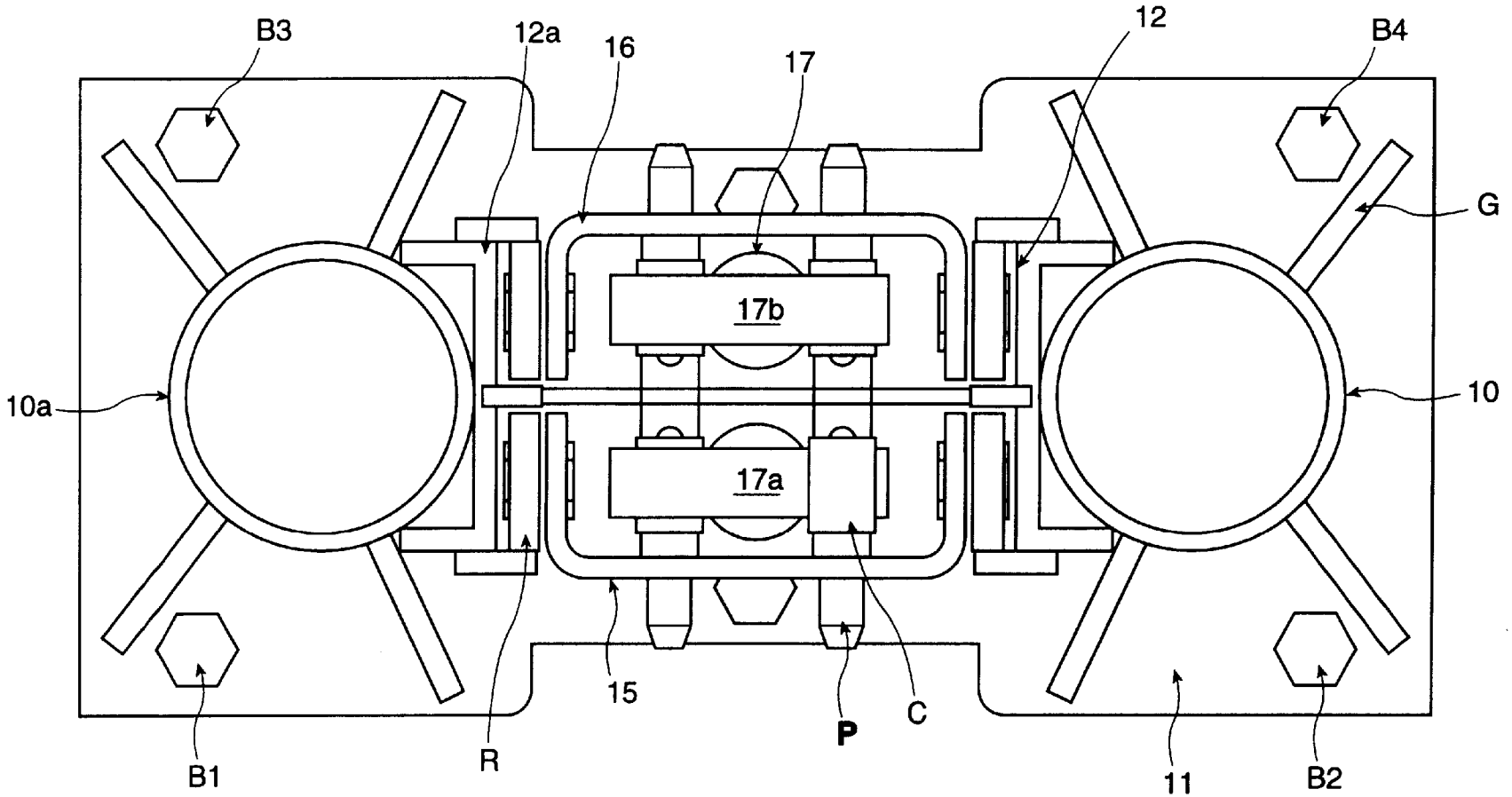
FIG. 4 is a close up top view of the mounting floor plate 11 of FIG. 3 illustrated in a preferred embodiment of the invention.
Figure 5:
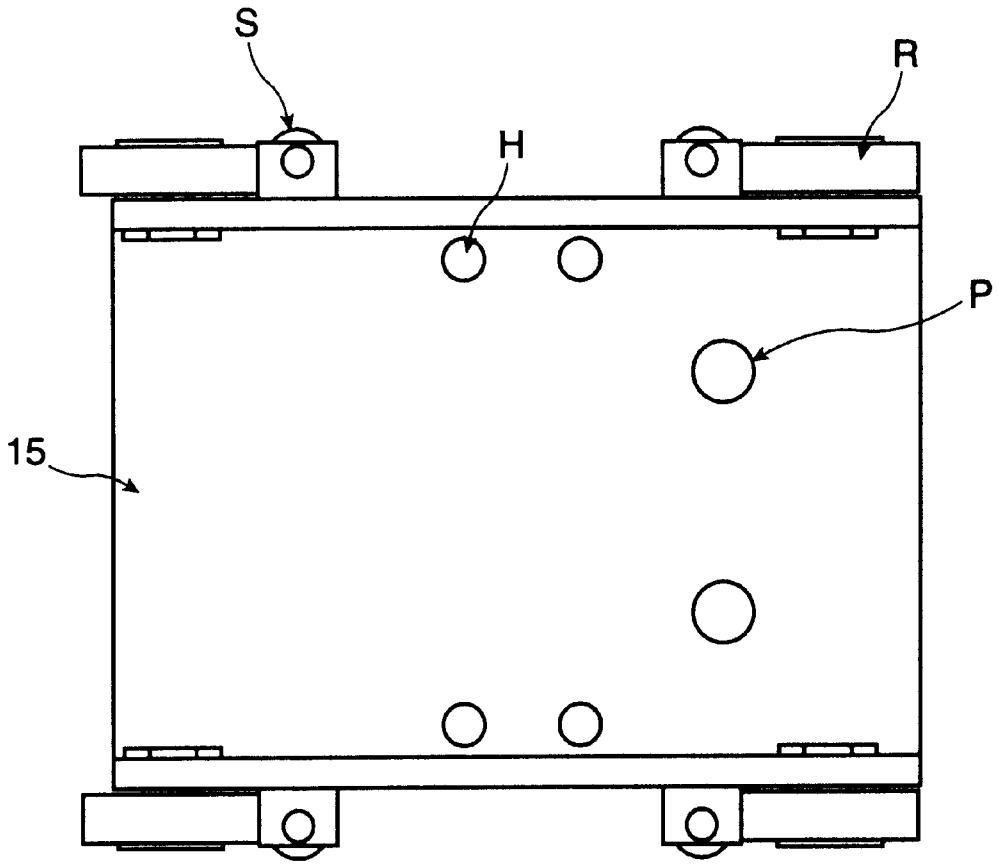
FIG. 5 is a side view of the lift carriage of FIG. 3 illustrated in a preferred embodiment of the invention.

Each upright support (10) is braced further with an upright channel (12 and 12A) being provided as best seen in relation to FIG. 4. Upright channel (12 and 12A) therefore includes a generally C-shaped structure attached and preferably welded to the support (10 and 10A) which is further braced by generally I-Beam shaped structure to form the upright compound channel (12 and 12A). This channel is attached and preferably welded top and bottom to the members (10 and 10A) and further accommodates between the lift carriage and the upright channel, a space for the guide rollers are to move as the carriage (15) is moved. A support (12A and 12B) is provided adjacent each channel to support the cylinder and hydraulic ram (17) as it moves. Additional side rollers (S) as seen in FIG. 5 are provided on the lift carriage (15) which is mounted as best seen in FIG. 5 the mounting holes (H) to allow the support pins (P) to carry the lift tongues (20 and 30) as best seen in FIGS. 1 and 2. As best seen in FIG. 3, the lifting tongues are engaged with the lifting carriage (15 and 16) via the pins. Each tongue includes pivoting lifting arms, pivoted to members (30B and 30C) extending from the tongues (30 and 30A), and pivoting at pivots (X, Y, Z and W) to allow the pivoting arms (25, 26, 35, 36, 25A, 26A, 35A and 36A) to engage the undercarriage of a vehicle via the lifting pads (T). As the vehicle is lifted, once the pads engage the undercarriage of the vehicle, the lifting carriage will advance upwardly as the hydraulic ram advances upwardly moving the lift chain (18) against the carriage between the bottom position and the servicing position. A lift yoke (17A) is provided with each piston to allow the chain to be anchored at one end and move around a lift yoke to the lift carriage (15).

As best seen in FIG. 4, the support pins (P) extend from the carriage assembly (15 and 16) to the tongues (30 and 30A) and the carriage assemblies. The carriage therefore is guided via the guide rollers (R) and side rollers (S), to and from the service position braced by the upright channels and upright supports 10 and 10A, and 12 and 12A respectively.

Figure 6:
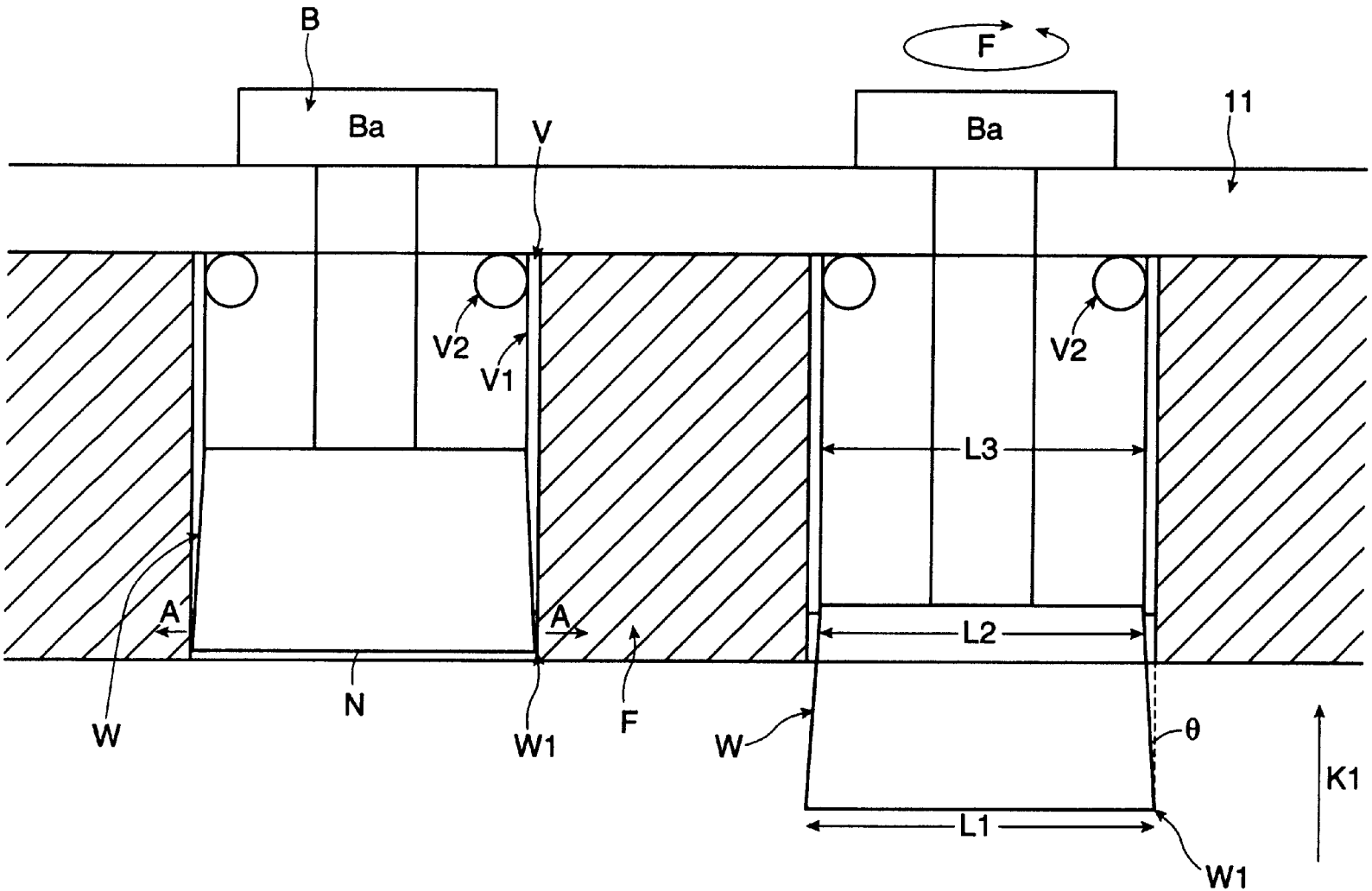
FIG. 6 is a schematic view of the floor plate 11 and unique anchor bolts provided therewith and illustrated in a preferred embodiment of the invention.

Referring now to FIG. 6, there is illustrated the anchor assembly for bolts B1 through B4. Generically therefore, bolts BA are to be anchored in an opening established in the concrete floor (F). The openings in the concrete floor (F) are sized to accommodate a cylinder or anchor sleeve (V) and an anchor piston (N). Generally, in a preferred embodiment, the bolt is a 1 inch bolt and the anchor piston is a 3 ½ inch diameter plus between 0.020 and 0.050 inches and the anchor sleeve is 3 ½ inches minus 0.020 inches. The opening is generally formed at 3 ½ inches. The sleeve includes a bead (V2) formed near the top thereof adjacent the interior wall (V1). The anchor piston has a bottom diameter (L1) as discussed above. The other top diameter of the piston (L2) is slightly less as defined by an angle θ (theta) described by a vertical shown in dotted line in relation to the wall (W1) of the piston.

A hole is therefore formed in the concrete floor at the required locations anchoring the base plate (11). The anchor sleeve (V) is inserted in the opening. The bolt is then inserted through the anchor sleeve (V) into the threaded opening (not shown) within the piston end. As the bolt (BA) is rotated therefore in the direction shown (F) in a direction pending to tighten the bolt depending on whether a left hand or a right hand thread is utilized, the piston end will be drawn up towards the bolt and the bottom diameter (L1) will compress against the inner wall (V1) of the anchor sleeve (V) compressing it into the concrete floor and anchoring the bolt when it is torqued to the predetermined level. Preferably the bolts are tightened to between 12,000 and 15,000 foot pounds of torque and yield a 60 ton tensile load capacity for each of the one inch anchor bolts. Each bolt is a grade number 5.

DESCRIPTION OF THE COLOURED PHOTOGRAPHS

Further, attached to this application are photographs labeled 1 through 14 showing the use of the Multi Vehicle Position Cantilevered Lift and it's ability to function in practical situations as claimed. These photographs are to be compared with FIGS. 1 through 6. (For example photograph #13 clearly illustrates the thickness of plate 11 and gussets (G). Photograph #11 shows the chain drive. Photograph #10 shows the electric motor, pump and fluid reservoir.)

Photograph #1 shows the a two vehicle position cantilevered lift having two vehicles at the service position.

Photograph #2 shows the size of the building within which the two vehicle position cantilevered lift unit may be installed and the headroom required when the vehicles are at the service position.

Photograph #3 shows a view of the lift arms.

Photograph #4 shows the basic support structure of the invention.

Photograph #5 shows the ability of a technician to move around under the vehicle.

Photograph #6 shows the stability of the lift with two vehicles at the service position with the safety device in the operative position. (Not shown)

Photograph #7 shows the positioning of the lift carriage and arms with respect to the undercarriage of the vehicle.

Photograph #8 shows the headroom available to a technician.

Photograph #9 shows the hydraulic hoses in relation to the frame. Preferably these hoses would be hidden inside the supporting structure as described in relation to the figures for reasons apparent from the photograph.

Photograph #10 shows the electric drive, pump, and fluid reservoir which would also be hidden inside the supporting structure as described in relation to the figures for reasons apparent from the photograph.

Photograph #11 shows a close-up of the chain drive and the lift yoke of the hydraulic ram assembly.

Photograph #12 shows the invention installed in a situation having minimum overhead clearance.

Photograph #13 shows the thickness of the base plate 11 and the reinforcing gussets G.

Photograph #14 shows the lifting carriage from behind.

It is imperative when providing the supports that they be extremely stiff and resist the torque loads and twisting loads that will be experienced when raising and lowering vehicles at alternative positions supported from the centrally disposed support. Literally, we have found that a larger footprint may therefore be required then those of standard type floor mounted systems. We have found that a 48" by 23" footprint is adequate, if the preferred two column like supports are adequately spaced apart having a diameter of 10 ¾" and a wall thickness of 0.31800 of an inch. Thus it may be provided proximate the bottom of the supports' reinforcements to reinforce the plate with respect to the supports and the base plate. It is recommended that the anchor bolt system described above be utilized and tightened to 1200 to 1500 foot pounds of torque in order to yield the required 60 ton tensile load capacity for each of the one inch anchor bolts. The material utilized in manufacturing the support structure is CSA G40.21 44W structural weldable steel. Preferably square I-beam type columns are attached and preferably welded to each of the spaced supports for the support structure.

The anchor assembly may further comprise a sleeve having a diameter of 3 ½" minus 0.050 inches and being cylindrical in shape and designed to allow for compression of the cylinder into the wall of the concrete surrounding the opening. The piston is designed having a base having a 3 ½" diameter plus in the range of 0.020 to 0.050 inches, so that as the piston is drawn up by the one inch bolt, preferably grade number 5, the base of the piston will compress the cylinder wall into the concrete continuously from the bottom of the cylinder toward the top of the cylinder until such time as the bolt is tightened to the predetermined and recommended torque of between 1200 and 1500 foot pounds. At that point the anchor is capable of 60 tons of tensile loading capacity on each bolt.

As many changes can be made to the preferred embodiments without departing from the scope of the invention, it is intended that all material contained herein be interpreted as illustrative of the invention and not in a limiting sense.

The embodiments of the invention in which an exclusive property or privilege is claimed are as follows:

1. A two vehicle cantilevered lift comprising a stiff support for the cantilevered lift, said support being sized so as to be resistant to twist and torque loads, and including two hollow columns spaced from one another so as to resist said torque and twist loads resulting when servicing a vehicle, said support having a base plate with openings for selective alignment with openings provided in a concrete floor or footing, said support being braced to the base plate, the openings in said floor having disposed therein an anchoring member comprising a compressible sleeve having a predetermined diameter and a threaded piston, having a predetermined diameter slightly larger than the sleeve and being contained in said sleeve and having a threaded internal or interior wall for receiving an anchor bolt and having a substantially tapered outer wall wherein as the bolt is fastened to a predetermined torque, the piston rises in the sleeve and expands the sleeve compressing the sleeve outwardly against the concrete surrounding the opening to anchor the sleeve and the bolt in the base plate, said support including framework to movably engage and support two cantilevered vehicle lifts moveable between a first lowered vehicle access position and a second raised vehicle service position respectively for a vehicle, each lift being affixed to said support separately and including cantilevered arms extending therefrom to support a vehicle, each cantilevered lift having a separate drive provided therefore, wherein a vehicle may be lifted by each cantilevered lift without interfering with the adjacent cantilevered lift.

2. The cantilevered lift of claim 1 wherein, said cantilevered arms are outwardly extendable and pivotable to engage a vehicle at appropriate undercarriage positions.

3. The cantilevered lift of claim 2 wherein said lift includes a ratchet operated safety mechanism to prevent the lift from moving from any of a multitude of raised positions, said safety including a multiplicity of vertical disposed openings in a frame engaged by a spring biased pin.

4. A two vehicle cantilevered lift comprising a central support structure bolted to a concrete floor or footing and including two hollow columns spaced from one another so as to resist torque and twist loads resulting when servicing a vehicle, said support structure for supporting two cantilevered lifts, each lift being affixed to said central support structure separately and including cantilevered arms extending therefrom to support a vehicle and being operable independently of one another to raise and lower vehicles between a first lowered vehicle access position and a second raised vehicle service position wherein a vehicle may be lifted by each lift without interfering with an adjacent lift.

5. The cantilevered lift of claim 4 wherein a safety mechanism is provided for each lift to prevent the lift from moving from a raised position.

6. The cantilevered lift of claim 4 wherein said cantilevered arms are outwardly extendable and pivotable to engage a vehicle at appropriate undercarriage positions.

* * * * *